US011486655B2

(12) United States Patent
Lee et al.

(10) Patent No.: US 11,486,655 B2
(45) Date of Patent: Nov. 1, 2022

(54) OUTDOOR UNIT OF AIR CONDITIONER

(71) Applicant: LG ELECTRONICS INC., Seoul (KR)

(72) Inventors: Sangyeul Lee, Seoul (KR); Juhyok Kim, Seoul (KR); Hongseong Kim, Seoul (KR); Sungwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 131 days.

(21) Appl. No.: 17/254,267

(22) PCT Filed: Jun. 20, 2019

(86) PCT No.: PCT/KR2019/007432
§ 371 (c)(1),
(2) Date: Dec. 19, 2020

(87) PCT Pub. No.: WO2019/245291
PCT Pub. Date: Dec. 26, 2019

(65) Prior Publication Data

US 2021/0123691 A1 Apr. 29, 2021

(30) Foreign Application Priority Data

Jun. 20, 2018 (KR) ..... 10-2018-0070928

(51) Int. Cl.
*F28D 1/04* (2006.01)
*F28F 1/32* (2006.01)
(Continued)

(52) U.S. Cl.
CPC ..... *F28F 1/325* (2013.01); *F24F 1/18* (2013.01); *F28F 1/128* (2013.01); *F28F 2215/04* (2013.01); *F28F 2215/08* (2013.01)

(58) Field of Classification Search
CPC ..... F28F 1/325; F28F 1/128; F28F 2215/04; F28F 2215/08; F24F 1/18
(Continued)

(56) References Cited

U.S. PATENT DOCUMENTS 4,705,105 A * 11/1987 Cur ..... F28F 1/325 165/151
5,042,576 A * 8/1991 Broadbent ..... F28F 1/325 165/181
(Continued)

FOREIGN PATENT DOCUMENTS

JP H07-198167 8/1995
JP 2012-002503 1/2012
(Continued)

OTHER PUBLICATIONS

International Search Report (with English Translation) and Written Opinion dated Oct. 16, 2019 issued in Application No. PCT/KR2019/007432.

*Primary Examiner* — Claire E Rojohn, III
(74) *Attorney, Agent, or Firm* — Ked & Associates

(57) ABSTRACT

Provided is an outdoor unit of an air conditioner, including: an outdoor heat exchanger that has a height longer than a width; and an outdoor blowing fan that is disposed above the outdoor heat exchanger and blows air upward from below the outdoor heat exchanger, in which the outdoor heat exchanger includes: a plurality of radiating fins that contacts air; a gap that is formed between the radiating fins; a louver fin that is cut in the radiating fin and then bent; and a cut-out area that is formed in the radiating fin and formed at a position where the louver fin is cut, the radiating fin includes: a first zone that is disposed above the outdoor heat exchanger and disposed close to the outdoor blowing fan; and a second zone that is located below the first zone, and
(Continued)

an area LA1 of the louver fin in the first zone is formed to be larger than an area LA2 of the louver fin in the second zone.

The present disclosure has the advantage of uniformly forming air volumes in each zone of the heat exchanger in the vertical height direction by making the areas of the louver fins arranged in each zone different, even when the outdoor blowing fan is disposed to be biased upward.

15 Claims, 7 Drawing Sheets

(51) Int. Cl.
*F24F 1/18* (2011.01)
*F28F 1/12* (2006.01)

(58) Field of Classification Search
USPC ..... 165/151
See application file for complete search history.

(56) References Cited

U.S. PATENT DOCUMENTS 5,353,866 A * 10/1994 Ueda ..... F28F 1/325 165/181
5,692,561 A * 12/1997 Kang ..... F28F 1/325 165/181
5,794,690 A * 8/1998 Kim ..... F28F 1/325 165/181
5,887,649 A * 3/1999 Kim ..... F28F 1/325 165/181
5,890,532 A * 4/1999 Kim ..... F28F 1/325 165/151
5,915,471 A * 6/1999 Kim ..... F28F 1/325 165/181
5,927,392 A * 7/1999 Youn ..... F28F 1/325 165/151
5,975,199 A * 11/1999 Park ..... F28F 17/005 165/181
6,227,289 B1 * 5/2001 Yokoyama ..... F28F 1/325 165/135
6,431,263 B2 * 8/2002 Oh ..... F28F 1/325 165/181
6,786,274 B2 * 9/2004 Bemisderfer ..... F28D 1/0477 165/181
7,021,370 B2 * 4/2006 Papapanu ..... F28F 1/325 62/515
D858,466 S * 9/2019 Vance ..... D13/179
D906,268 S * 12/2020 Mahajan ..... D13/179
10,921,065 B2 * 2/2021 Mahajan ..... F28F 9/013
11,326,842 B2 * 5/2022 Kim ..... F28F 1/34
2001/0035284 A1 * 11/2001 Iwasaki ..... F28D 1/0435 165/135
2005/0241813 A1 * 11/2005 Choi ..... F28D 1/0477 165/151
2007/0151716 A1 * 7/2007 Lee ..... F28F 17/005 165/151
2007/0163764 A1 * 7/2007 Kaga ..... F28F 1/325 165/182
2007/0169921 A1 * 7/2007 Abrahamian ..... F28F 1/325 165/151
2009/0050303 A1 * 2/2009 Komori ..... F28D 1/0477 165/151
2009/0084129 A1 * 4/2009 Kim ..... F28F 13/08 62/502
2009/0199585 A1 * 8/2009 Ogawa ..... F28F 1/32 165/182
2009/0308585 A1 * 12/2009 Chen ..... F28F 1/325 165/185
2011/0120681 A1 * 5/2011 Seo ..... F24F 13/30 165/151
2018/0306533 A1 * 10/2018 Alahyari ..... F28F 19/006
2018/0328285 A1 * 11/2018 Tajiri ..... F28D 1/0246
2021/0325127 A1 * 10/2021 Feng ..... F28F 1/325

FOREIGN PATENT DOCUMENTS

KR 10-2004-0098277 11/2004
KR 10-2006-0015977 2/2006
KR 10-2009-0052058 5/2009
KR 10-2015-0007446 1/2015

* cited by examiner

OUTDOOR UNIT OF AIR CONDITIONER

CROSS-REFERENCE TO RELATED PATENT APPLICATIONS

This application is a U.S. National Stage Application under 35 U.S.C. § 371 of PCT Application No. PCT/KR2019/007432, filed Jun. 20, 2019, which claims priority to Korean Patent Application No. 10-2018-0070928, filed Jun. 20, 2018, whose entire disclosures are hereby incorporated by reference.

TECHNICAL FIELD

The present invention relates to an outdoor unit of an air conditioner, and more particularly, to an outdoor unit of an air conditioner capable of uniformly forming air flow in a vertical direction.

BACKGROUND ART

In general, an air conditioner includes a compressor, a condenser, an evaporator, and an expander, and supplies cold or warm air to a building or a room using an air conditioning cycle.

The air conditioner is structurally divided into a separate type in which the compressor is disposed outdoors and an all-in-one type in which the compressor is integrally manufactured.

In the separate type, an indoor heat exchanger is installed in the indoor unit, and an outdoor heat exchanger and a compressor are installed in the outdoor unit to connect two separate devices with a refrigerant pipe.

In the all-in-one type, the indoor heat exchanger, the outdoor heat exchanger, and the compressor are installed in one case. Examples of the all-in-one type air conditioner include a window-type air conditioner that is installed directly by hanging a device on a window, a duct-type air conditioner that is installed outside a room by connecting a suction duct and a discharge duct, and the like.

Examples of the separate type air conditioner include a stand-type air conditioner that is installed upright, a wall-mounted air conditioner that is installed by hanging it on a wall, and the like.

In addition, as a type of the separate type air conditioner, there is a system air conditioner capable of providing air-conditioned air to a plurality of spaces.

In the case of a multi-type air conditioner, more indoor units are provided than the number of outdoor units. Therefore, a plurality of indoor units may be provided in one outdoor unit.

In the case of a large-capacity outdoor unit, a structure that sucks air from a side and discharges air upward is widely used.

In the case of the large-capacity outdoor unit, since an outdoor blowing fan is disposed above the outdoor heat exchanger, there is a problem that the air flow is non-uniform in a vertical direction of the outdoor heat exchanger.

That is, when the outdoor blowing fan is disposed above the outdoor heat exchanger, since the air flow is weak in a lower side of the outdoor heat exchanger, and the air flow is strong above the outdoor heat exchanger, there is a problem in that heat exchange is formed non-uniformly above and below the outdoor heat exchanger.

RELATED ART DOCUMENT

Patent Document

Japanese Patent Laid-Open Publication No. 2012-002503 A

DISCLOSURE

Technical Problem

The present invention provides an outdoor unit of an air conditioner capable of uniformly forming an air flow above and below an outdoor heat exchanger even when an outdoor blowing fan is disposed above the outdoor heat exchanger.

The present invention also provides an outdoor unit of an air conditioner capable of uniformly forming a flow rate of air above and below an outdoor heat exchanger.

The present invention also provides an outdoor unit of an air conditioner capable of eliminating non-uniformity due to a pressure loss in a vertical direction of an outdoor heat exchanger.

The present invention also provides an outdoor unit of an air conditioner capable of solving non-uniformity of a flow rate of air according to a vertical height when an outdoor blowing fan is disposed above the outdoor heat exchanger in the outdoor heat exchanger having a height of 1 m or more.

The problems of the present disclosure are not limited to the above-mentioned problems. That is, other problems that are not mentioned may be obviously understood by those skilled in the art from the following specification.

Technical Solution

The present disclosure may uniformly form air volumes in each zone of an outdoor heat exchanger in a vertical height direction by making areas of louver fins arranged in each zone different, even when in an outdoor heat exchanger having a height of 1 m or more, an outdoor blowing fan is disposed above the outdoor heat exchanger.

The present disclosure is that the outdoor heat exchanger is divided into a plurality of zones in the vertical direction, and a unit area of a louver fin arranged on an upper zone is larger than a unit area of a louver fin arranged in a lower zone, so air volumes of each zone may be formed uniformly.

The present disclosure may eliminate non-uniformity due to pressure loss by uniformly forming an air volume in a plurality of zones arranged in a vertical direction of an outdoor heat exchanger.

According to the present disclosure, an outdoor heat exchanger may uniformly form air volumes in each zone of the heat exchanger in the vertical height direction by making the areas of the louver fins arranged in each zone different, even when the outdoor blowing fan is disposed to be biased upward.

In an aspect, an outdoor unit of an air conditioner includes: an outdoor heat exchanger that has a height longer than a width; and an outdoor blowing fan that is disposed above the outdoor heat exchanger and blows air upward from below the outdoor heat exchanger, in which the outdoor heat exchanger includes: a plurality of radiating fins that contacts air; a gap that is formed between the respective radiating fins; a louver fin that is cut in each of the radiating fins and then bent in a direction crossing the radiating fins;

and a cut-out area that is formed in the radiating fin and formed at a position where the louver fin is cut, the radiating fins include: a first zone that is disposed above the outdoor heat exchanger and disposed close to the outdoor blowing fan; and a second zone that is disposed below the first zone, and an area LA1 of the louver fin in the first zone is larger than an area LA2 of the louver fin in the second zone.

Since the area LA1 of the louver fin in the first zone is formed to be larger than the area LA2 of the louver fin in the second zone, the air volume in the first zone close to the outdoor blowing fan and the air volume in the second zone far from the outdoor blowing fan may be formed uniformly.

When an average wind velocity of air passing through the first zone is V1, and an average wind velocity passing through the second zone is V2, the average wind velocities of each zone and areas of the louver fins in each zone may satisfy the following ratio: V1:V=LA1:LA2.

The area of the louver fin may be a total area of the louver fins arranged in the corresponding zone.

The area of the louver fin may be the area of the louver fin per unit area of the radiating fin arranged in the corresponding zone.

The outdoor heat exchanger may further include a tube through which a refrigerant flow, and the tube may be disposed to penetrate through the radiating fins of the first zone and the radiating fins of the second zone.

The radiating fins may be arranged in a horizontal direction, and the tube may be arranged in a vertical direction.

The louver fin may be arranged to be inclined in a vertical direction.

The outdoor unit may further include: a base; a case that is coupled to the base, is disposed above the base, and surrounds an edge of the base; and a compressor that is disposed inside the case, disposed above the base, and compresses a refrigerant, in which the outdoor heat exchanger may further include a first outdoor heat exchanger and a second outdoor heat exchanger that are disposed inside the case, disposed above the base, and exchange heat between a refrigerant and air, and the outdoor blowing fan may further include: a first outdoor blowing fan that is disposed inside the case, discharges the air inside the case to the outside, and is disposed above the first outdoor heat exchanger; and a second outdoor blowing fan that is disposed inside the case, discharges the air inside the case to the outside, and disposed above the second outdoor heat exchanger.

The height of the first outdoor heat exchanger and the second outdoor heat exchanger may be 1 meter or more.

When viewed in plan view, the first outdoor heat exchanger and the second outdoor heat exchanger may have a "ㄷ" shape disposed to face each other, and one end and the other end of the first outdoor heat exchanger may be spaced apart from one end and the other end of the second outdoor heat exchanger.

The outdoor unit may further include a second bracket that covers between the spaced other ends of the first outdoor heat exchanger and the second outdoor heat exchanger.

In another aspect, an outdoor unit of an air conditioner includes: an outdoor heat exchanger that has a height longer than a width; and an outdoor blowing fan that is disposed above the outdoor heat exchanger and blows air upward from below the outdoor heat exchanger, in which the outdoor heat exchanger includes: a plurality of radiating fins that are arranged in a vertical direction; a gap that is formed in a horizontal direction between the respective radiating fins; a louver fin that is cut in each of the radiating fins and then bent in a direction crossing the radiating fins; and a cut-out area that is formed in the radiating fin and formed at a position where the louver fin is cut, the radiating fins include: a first zone that is disposed above the outdoor heat exchanger and disposed close to the outdoor blowing fan; a second zone that is disposed below the first zone; a third zone that is disposed below the third zone; and a fourth zone that is disposed below the third zone, and an area LA1 of the louver fin in the first zone is formed to be larger than an area LA2 of the louver fin in the second zone, and the LA2 of the louver fin in the second zone is formed to be narrower than the area LA3 of the louver fin in the third zone, and the area LA3 of the louver fin in the third zone is formed to be larger than an area LA4 of the louver fin in the fourth zone.

When an average wind velocity of air passing through the first zone is V1, an average wind velocity passing through the second zone is V2, an average wind velocity of air passing through the third zone is V3, and an average wind velocity passing through the fourth zone is V4, the average wind velocities of each zone and the areas of the louver fins in each zone may satisfy the following ratio: V1:V2:V3:V4=LA1:LA2:LA3:LA4.

The area LA1 of the louver fin in the first zone, the area LA2 of the louver fin in the second zone, the area LA3 of the louver fin in the third zone, and the area LA4 of the louver fin in the fourth zone may be formed to be gradually reduced.

The outdoor unit may further include: a base; a compressor that is disposed inside the case, is located above the base, and compresses a refrigerant, in which the outdoor heat exchanger further includes a first outdoor heat exchanger and a second outdoor heat exchanger that are disposed inside the case, are located above the base, and exchange heat between a refrigerant and air, and the outdoor blowing fan further includes: a first outdoor blowing fan that is disposed inside the case, discharges the air inside the case to the outside, and is disposed above the first outdoor heat exchanger; and a second outdoor blowing fan that is disposed inside the case, discharges the air inside the case to the outside, and is disposed above the second outdoor heat exchanger.

Advantageous Effects

The air conditioner heat exchanger according to the present disclosure has one or more of the following effects.

First, the present disclosure has the advantage in that even when the outdoor blowing fan is located to be biased upward, it is possible to uniformly form air volumes in each zone of the heat exchanger in the vertical height direction by making the areas of the louver fins arranged in each zone different.

Second, the present disclosure has the advantage in that by forming the wide area of the louver fin in the first zone close to the outdoor blowing fan and forming the narrow area of the louver fin in the fourth zone farthest away from the outdoor blowing fan, the pressure loss of the zone disposed below the outdoor heat exchanger may be formed to be less than that of the zone disposed above the outdoor heat exchanger and thus the air volumes in each zone may be formed uniformly.

Third, the present disclosure has the advantage of improving the heat exchange efficiency of the heat exchanger by uniformly forming the air volumes in each zone and uniformly forming the amount of heat exchange between the refrigerant and air.

Fourth, the present disclosure is the advantage in that even if the height of the heat exchanger in the vertical direction exceeds 1 meter, the single fin-tube heat exchanger may be manufactured without stacking.

Fifth, the present disclosure has the advantage that it is possible to uniformly form the air volume according to the height difference by gradually increasing the area of the louver pin from the far side to the near side from the outdoor blowing fan.

MODE FOR INVENTION

Figure 1:
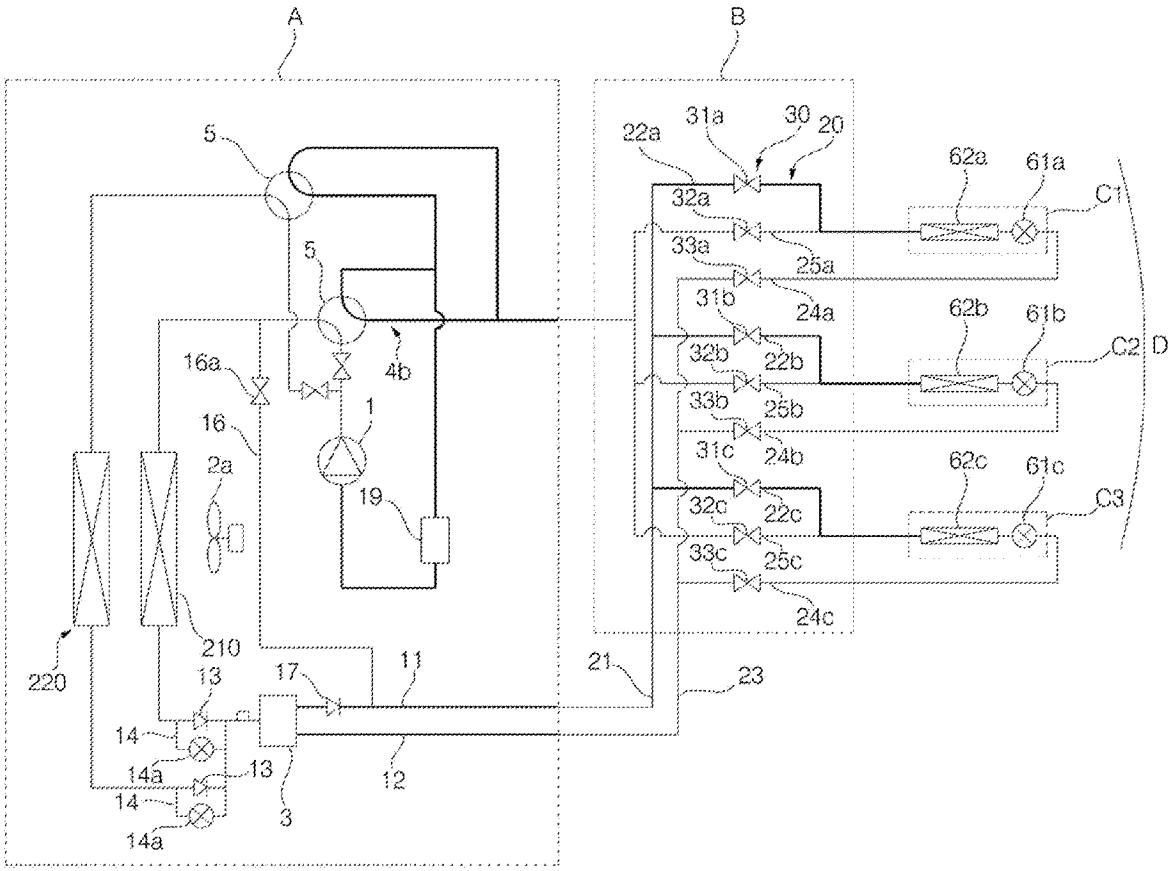
FIG. 1 is a block diagram of a multi-type air conditioner according to a first embodiment of the present disclosure.

Advantages and features of the present disclosure and methods accomplishing them will become apparent from the following description of embodiments with reference to the accompanying drawings. However, the present disclosure is not limited to the embodiments disclosed herein but will be implemented in various forms. The embodiments make contents of the present disclosure thorough and are provided so that those skilled in the art can easily understand the scope of the present disclosure. Therefore, the present disclosure will be defined by the scope of the appended claims. Throughout the specification, like reference numerals denote like elements.

Hereinafter, the present disclosure will be described in detail with reference to the accompanying drawings.

FIG. 1 is a block diagram of a multi-type air conditioner according to a first embodiment of the present disclosure.

A multi-type air conditioner according to the present disclosure includes an outdoor unit A, a distributor B, and a combined use indoor unit D connected to the distributor B.

The combined use indoor unit D may operate simultaneously by cooling or heating.

The configuration of the outdoor unit A, the distributor B, and the combined use indoor unit D will be described.

A compressor 1, outdoor heat exchangers 210 and 220, and a gas-liquid separator 3, and the like are disposed in the outdoor unit A, a guide pipe part 20 and a valve part 30 are disposed in the distributor B, and an indoor heat exchanger 62, an electronic expansion valve 61, and the like are disposed in each indoor unit D.

Hereinafter, a detailed embodiment of the outdoor unit A, the distributor B, and the combined use indoor unit D will be described in order.

The outdoor unit A has the following components.

The outdoor unit A includes a compressor 1, outdoor heat exchangers 210 and 220, an outdoor blowing fan 2*a* that provides air to the outdoor heat exchangers 210 and 220, a gas-liquid separator 3 that is provided on a pipe on a discharge side of the outdoor heat exchanger and separates a refrigerant discharged from the outdoor heat exchangers 210 and 220 into a gaseous refrigerant and a liquid refrigerant during simultaneous operation by cooling main constituents, an accumulator 19 that is connected to a suction side of the compressor 1 and provides a gaseous refrigerator to the compressor 1, and a four-way valve 5 that selectively connects the compressor 1, the outdoor heat exchangers 210 and 220, the distributor B, and the accumulator 19.

The outdoor unit A may further include a first connection pipe 4*a* that connects a discharge side of the compressor 1, the outdoor heat exchangers 210 and 220, and the gas-liquid separator 3, and a second connection pipe 4 that connects the distributor B and the suction side of the compressor 1.

The first connection pipe 4*a* and the second connection pipe 4*b* connect each device via the four-way valve 5.

The four-way valve 5 is connected to the discharge side of the compressor 1 and can selectively change a flow direction of a refrigerant according to the operating conditions.

The gas-liquid separator 3 is connected to a gaseous refrigerant pipe 11 and a liquid refrigerant pipe 12.

The gaseous refrigerant pipe 11 connects an upper portion of the gas-liquid separator 3 and the distributor B to guide the gaseous refrigerant, and the liquid refrigerant pipe 12 connects a lower portion of the gas-liquid separator and the distributor B to guide the liquid refrigerant.

During simultaneous operation by cooling all rooms and cooling main constituents, the refrigerant discharged from the outdoor heat exchangers 210 and 220 is introduced into the gas-liquid separator 3 along the first connection pipe 4*a*, and during simultaneous operation of heating all rooms and heating main constituents, the refrigerant introduced into the outdoor heat exchangers 210 and 220 is expanded and introduced.

To this end, a first check valve 13 is provided between the outdoor heat exchangers 210 and 220 and the gas-liquid separator 3 in the first connection pipe 4*a* to block a flow of refrigerant during the simultaneous operation by heating all rooms and heating main constituents and to pass the refrigerant during the simultaneous operation of the cooling all rooms and the cooling main constituents.

A parallel pipe 14 is arranged in parallel with the first connection pipe 4*a* based on the first check valve 13, and one side of the parallel pipe 14 is the outdoor heat exchangers 210 and 220 and the other side thereof is connected to the gas-liquid separator (3) side.

The parallel pipe 14 guides the refrigerant during the simultaneous operation by heating all rooms and heating main constituents.

The parallel pipe is provided with an electronic expansion valve 14*a* for heating, and the electronic expansion valve 14*a* for heating expands the refrigerant introduced into the outdoor heat exchangers 210 and 220 during the simultaneous operation by heating all rooms and heating main constituents.

In addition, a bypass pipe 16 that connects the first connection pipe 4*a* and the gaseous refrigerant pipe 11 is disposed, and the bypass pipe 16 is provided with a valve for heating main constituents 16*a*.

During the simultaneous operation by heating main constituents, the low-pressure gaseous refrigerant supplied from the distributor B flows into the suction side of the compressor 1 along the gaseous refrigerant pipe 11 and the bypass pipe 16.

Specifically, one side of the bypass pipe 16 is connected to the first connection pipe 4*a* between the compressor 1 and the outdoor heat exchangers 210 and 220, and the other side thereof is connected to the gaseous refrigerant pipe 11.

The valve for heating main constituents 16*a* is opened only during the simultaneous operation by heating main constituents.

A second check valve 17 is disposed between the gas-liquid separator 3 and the gaseous refrigerant pipe 11, and the second check valve 17 blocks the flow of the refrigerant from the distributor B into the gas-liquid separator 3 during the simultaneous operation by heating main constituents.

The outdoor unit A performs the following operations according to the driving conditions.

First, in the present embodiment, all-room operation means that all indoor units D connected to the distributor B are operated in the same mode. For example, cooling all-room operation means that all the indoor units D connected to the distributor B are operated by cooling. Heating all-room operation means that all the indoor units D connected to the distributor B are operated by heating.

In the present embodiment, the simultaneous operation means that some of the indoor units D connected to the distributor B are operated by cooling and some are operated by heating.

During the cooling all-room operation or the simultaneous operations by the cooling main constituents, the gaseous refrigerant discharged from the compressor 1 flows into the outdoor heat exchangers 210 and 220 via the first connection pipe 4*a* and the four-way valve 5, and the refrigerant heat-exchanged in the outdoor heat exchanger continues to flow along the first connection pipe 4*a*, passes through the first check valve 13, and then is introduced into the gas-liquid separator 3.

In particular, during the cooling all-room operation, the refrigerant introduced into the gas-liquid separator 3 is specified as a liquid state by controlling the number of rotations of the outdoor blowing fan 2*a* so that all the refrigerants introduced into the outdoor heat exchangers 210 and 220 are condensed.

During the heating all-room operation or the simultaneous operation by heating main constituents, the gaseous refrigerant discharged from the compressor 1 passes through the first connection pipe 4*a* and the four-way valve 5, and then flows into the second connection pipe 4*b* in a high-pressure state without passing through the outdoor heat exchangers 210 and 220 and flows into the distributor B along the second connection pipe.

Next, the distributor B has the following components.

Prior to the description of the configuration, the refrigerant introduced from the outdoor unit A according to the operating conditions needs to be accurately guided to the selected indoor unit D.

That is, based on the above-described contents, the distributor B includes the guide pipe part 20 that guides, to each indoor unit D, the refrigerant which is introduced without passing through the outdoor heat exchangers 210 and 220 and the gas-liquid separator 3 or is introduced via the outdoor heat exchanger and the gas-liquid separator according to the operating conditions, and re-guides the refrigerant heat-exchanged in the respective indoor unit to the outdoor unit A, and the valve part 30 that controls the flow of the refrigerant of the guide pipe part so that the refrigerant is selectively introduced into the plurality of indoor units D.

Here, the guide pipe part 20 includes a gaseous refrigerant connection pipe 21 that is connected to the gaseous refrigerant pipe 11 of the outdoor unit to guide the gaseous refrigerant, gaseous refrigerant branch pipes 22 that are branched from the gaseous refrigerant connection pipe 21 and are each connected to each of the indoor units D, a liquid refrigerant connection pipe 23 that is connected to the liquid refrigerant pipe 12 of the outdoor unit to guide the liquid refrigerant, liquid refrigerant branch pipes 24 that are branched from the liquid refrigerant connection pipe and are each connected to each of the indoor units D, connection branch pipes 25 that are branched from each of the gaseous refrigerant branch pipes 22, and a joint pipe 26 that joints each of the connection branch pipes into one and is connected to the second connection pipe 4*b* of the outdoor unit.

In addition, the valve part 30 is provided in each of the gaseous refrigerant branch pipes 22, each of the liquid refrigerant branch pipes 24, and each of the connection branch pipes 25, and is preferably constituted by a two-way valve that is selectively turned on/off according to operating conditions.

The operation of the distributor B configured as described above will be referred to in the overall operation description to be described later.

Next, each of the combined use indoor units D has the following components.

Each combined use indoor unit D includes an indoor heat exchanger 62 and an electronic expansion valve 61 that are connected and installed between the gaseous refrigerant branch pipe 22 and the liquid refrigerant branch pipe 24, and an indoor fan (not illustrated) that provides air to the heat exchanger.

Figure 2:
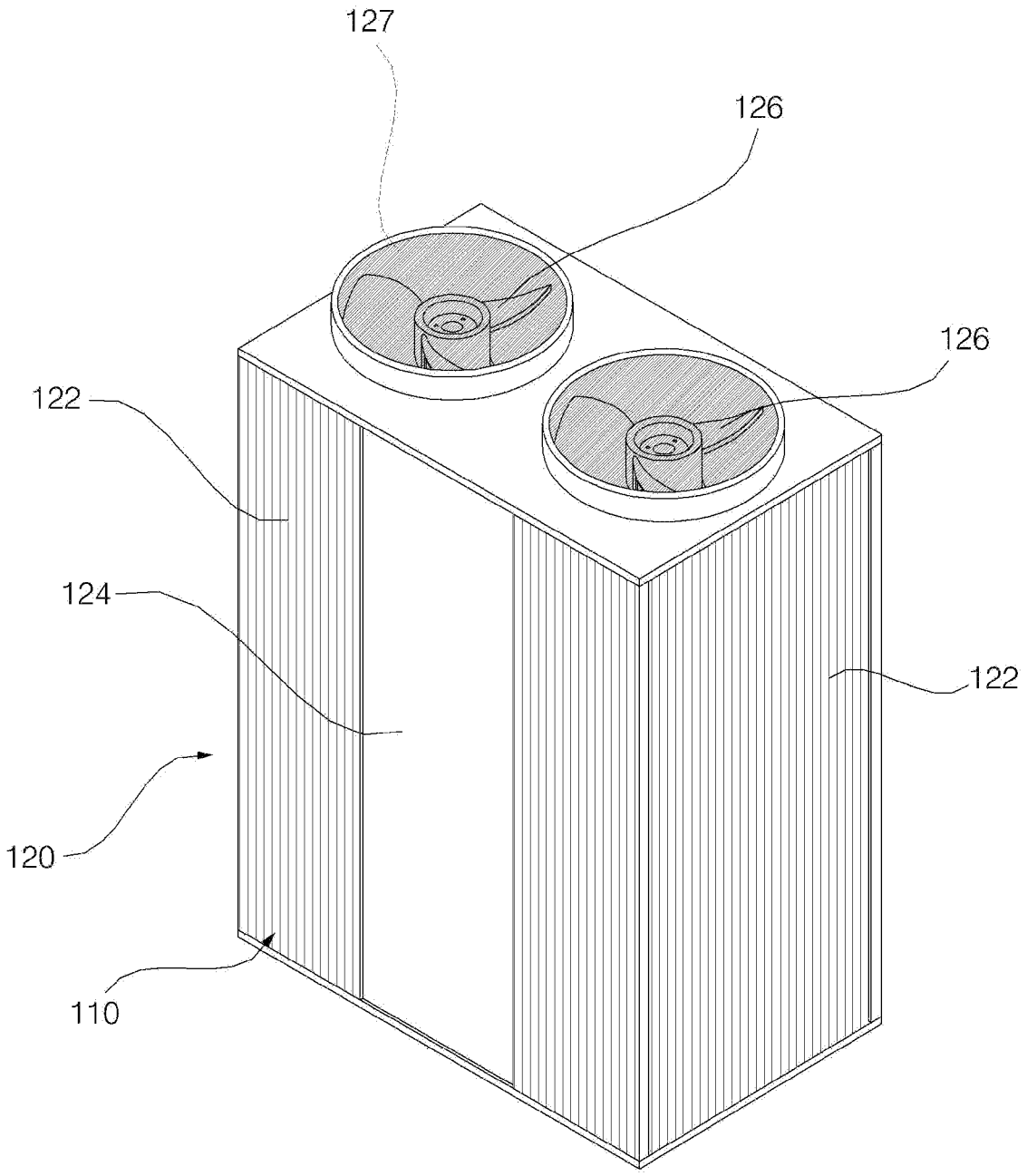
FIG. 2 is a perspective view of an outdoor unit according to the first embodiment of the present disclosure.
Figure 3:
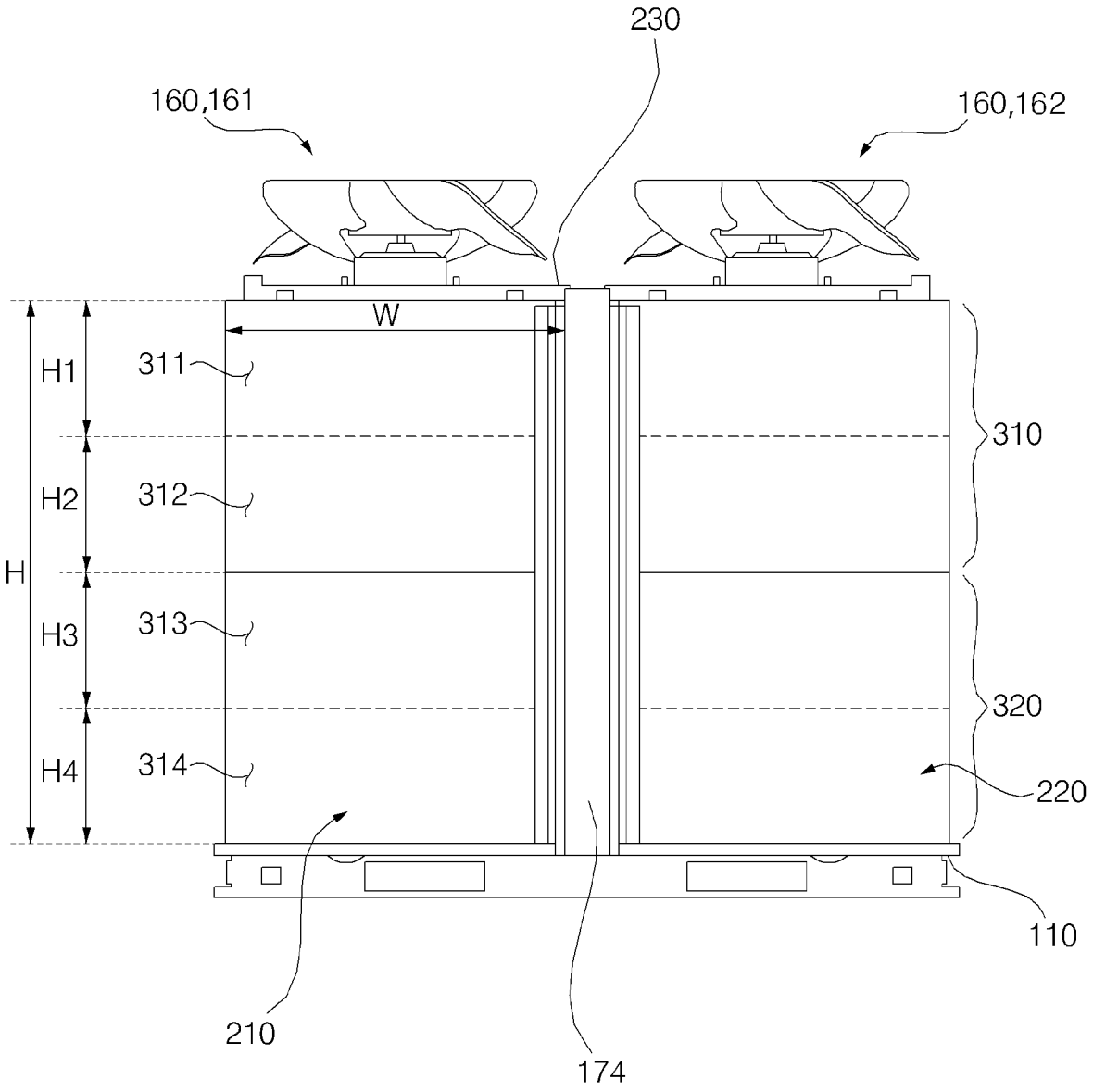
FIG. 3 is a front view of a heat exchanger and an outdoor blowing fan illustrated in FIG. 2.
Figure 4:
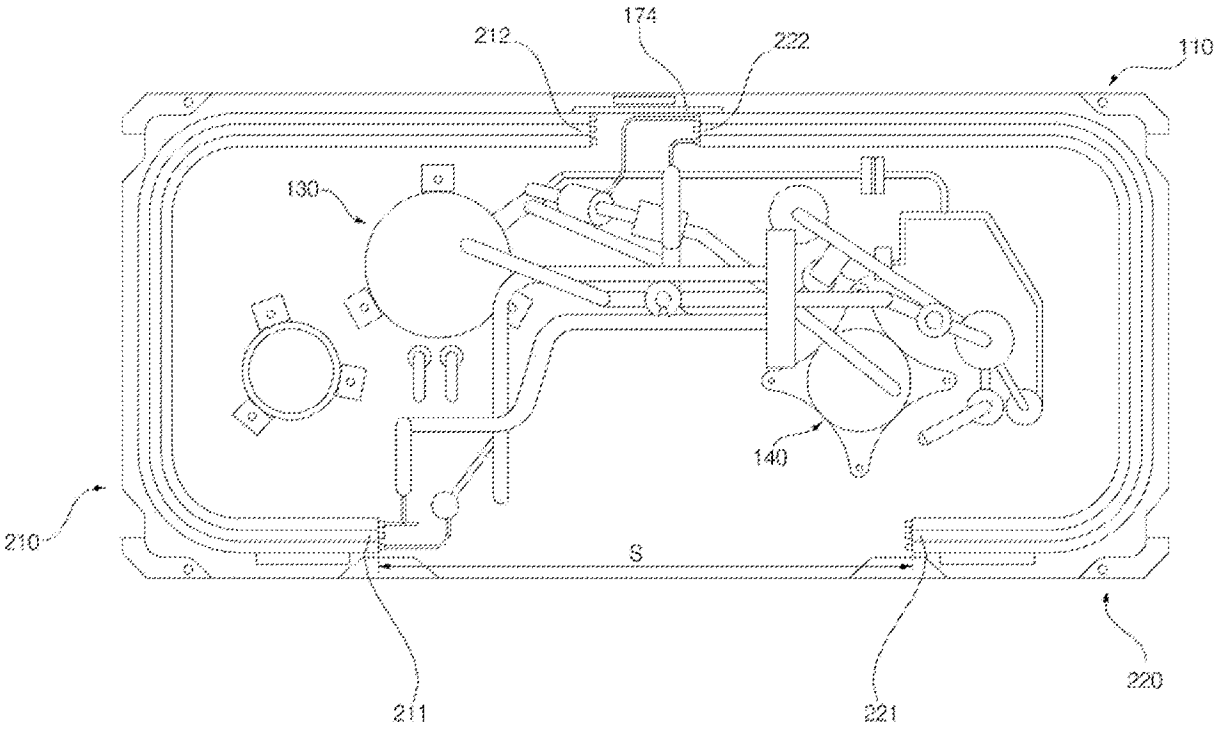
FIG. 4 is a plan view of FIG. 3.
Figure 5:
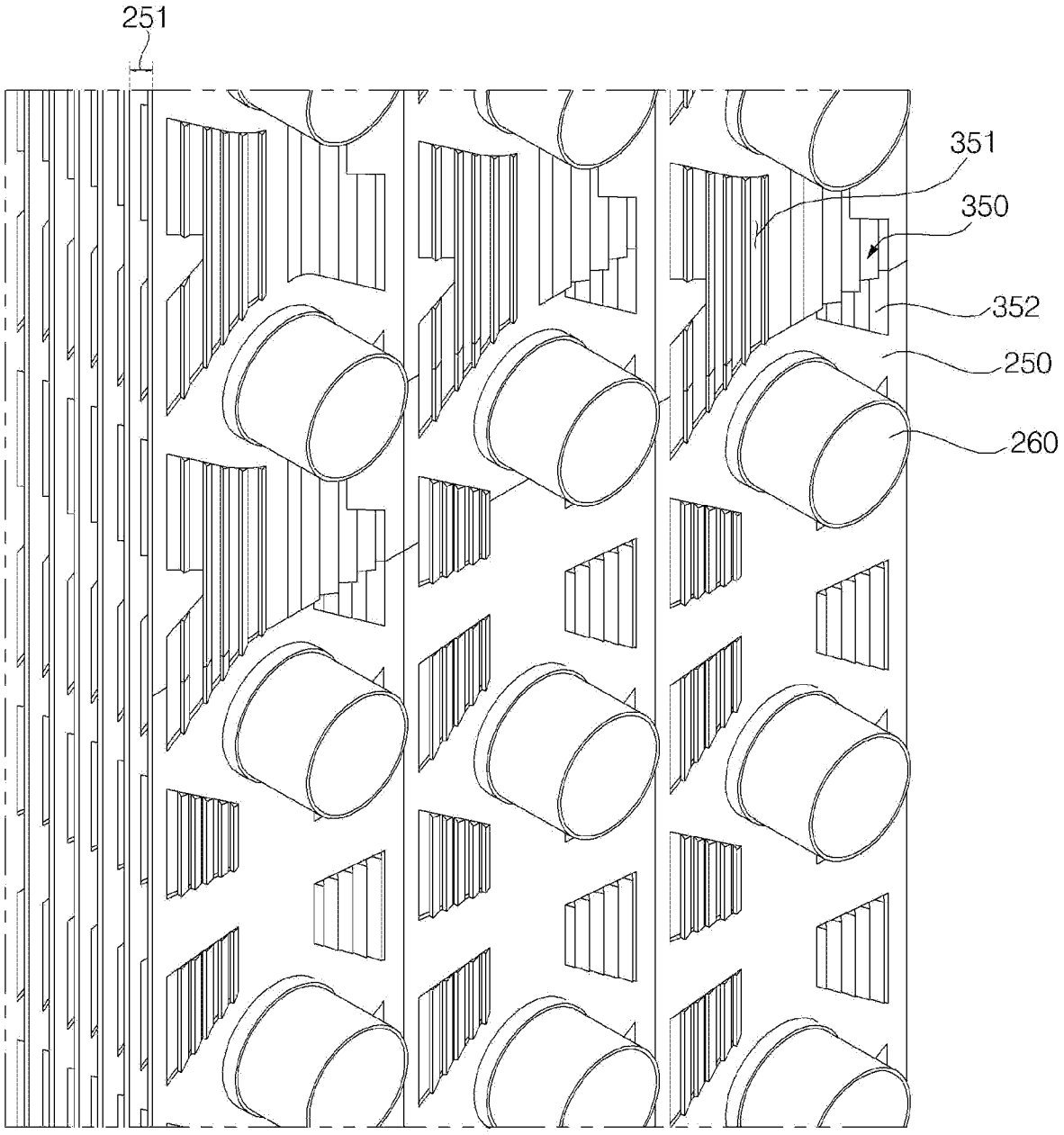
FIG. 5 is a partial perspective view of an outdoor heat exchanger of a louver according to the first embodiment of the present disclosure.
Figure 6:
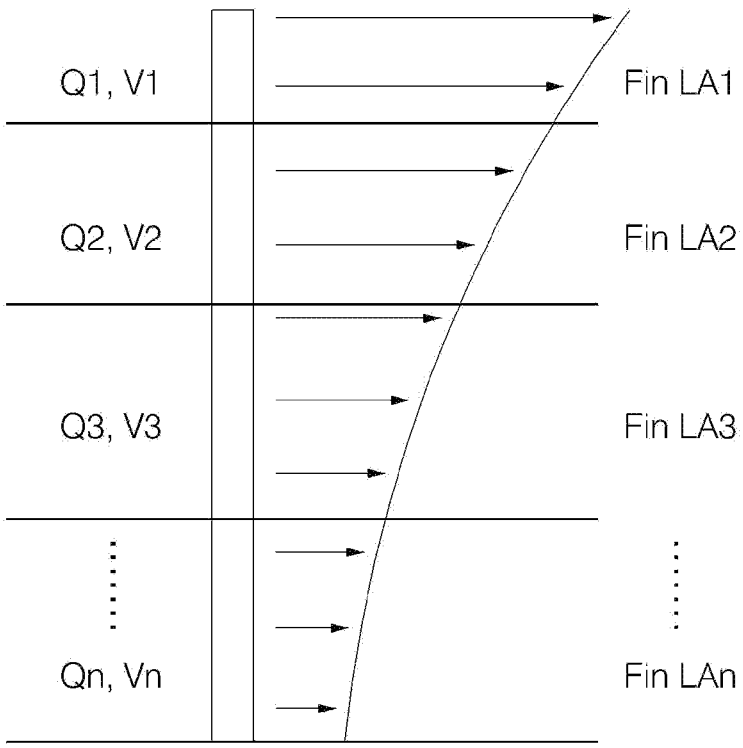
FIG. 6 is an exemplary view illustrating average wind velocities of each zone of a conventional outdoor heat exchanger.
Figure 7:
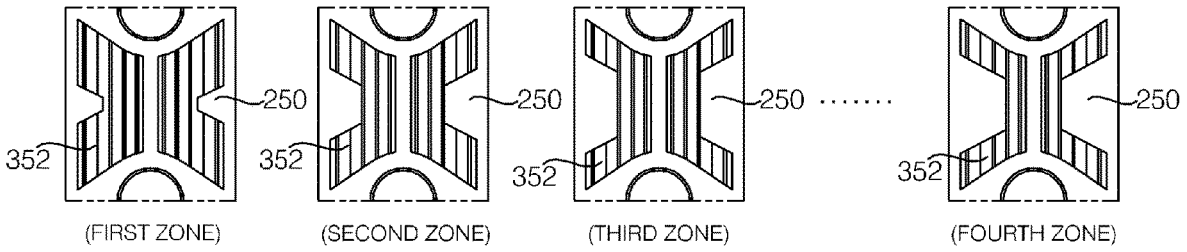
FIG. 7 is an exemplary view illustrating louver fins in each zone according to the first embodiment of the present disclosure.

FIG. 2 is a perspective view of the outdoor unit according to the first embodiment of the present disclosure, FIG. 3 is a front view of the heat exchanger and the outdoor blowing fan illustrated in FIG. 2, FIG. 4 is a plan view of FIG. 3, FIG. 5 is a partial perspective view of the outdoor heat exchanger of the louver according to the first embodiment of the present disclosure, FIG. 6 is an exemplary view illustrating average wind velocities of each zone of the conventional outdoor heat exchanger, and FIG. 7 is an exemplary view illustrating the louver fins in each zone according to the first embodiment of the present disclosure.

The outdoor unit A includes a base 110, a case 120 that is coupled to the base 110 and disposed above the base, a compressor 130 that is disposed inside the case 120, is disposed above the base 110, and compresses a refrigerant, an accumulator 140 that is disposed inside the case 120, is disposed above the base 110, and provides a gaseous refrigerant to the compressor 130, a four-way valve 150 that is disposed inside the case 120, disposed above the base 110, and switches a flow path of refrigerant discharged from the compressor 130, a first outdoor heat exchanger 210 and a second outdoor heat exchanger 220 that are disposed inside the case 120, are disposed above the base 110, and exchange heat between the refrigerant and air, and an outdoor blowing fan 160 that is disposed inside the case 120 and discharges the air in the case 120 to the outside.

The outdoor blowing fan disposed above the first outdoor heat exchanger 210 is referred to as a first outdoor blowing fan 161, and an outdoor blowing fan disposed above the second outdoor heat exchanger 220 is referred to as a second outdoor blowing fan 162. The base 110 is installed on the ground. The base 110 supports the load of the outdoor unit.

The case 120 includes an air panel 122 that forms a part of side surfaces of the outdoor unit A, is fixed to the base 110, and is provided with a plurality of holes through which external air is introduced thereinto, a service panel 124 that forms the rest of the side surfaces of the outdoor unit A, connects both ends of the air panel 122 to shield the inside of the case 120, and is separable from the air panel 122, and a discharge grill 126 that is disposed above the air panel 122 and the service panel 124 and discharges the air inside the outdoor unit A to the outside.

The air panel 122 is disposed on three of the four side surfaces of the outdoor unit A. The air panel 122 may be formed by bending one panel. In the present embodiment, the air panel 122 covers the remaining side surfaces except for a part of the front surface.

The service panel 124 may be separated from the case 120 by an operator. The service panel 124 and the air panel 122 constitute the side surfaces of the case 120.

The air panel 122 is formed on at least three of the four surfaces, thereby ensuring a maximum amount of sucked air.

It is preferable to minimize an area of the service panel 124 to maximize an area of the air panel 122.

In addition, when the service panel 124 is sucked into the case 120, it is preferable to minimize the air resistance and minimize the amount of air biasedly sucked into either the first outdoor heat exchanger 210 or the second outdoor heat exchanger 220.

The discharge grill 126 forms an upper surface of the case 120. The discharge grill 126 is provided with a discharge port 127 through which air is discharged.

The first outdoor heat exchanger 210 and the second outdoor heat exchanger 220 are located inside the air panel 122 and the service panel 124.

The height of the first outdoor heat exchanger 210 and the second outdoor heat exchanger 220 is 1 m or more.

The first outdoor heat exchanger 210 and the second outdoor heat exchanger 220 are disposed on one side and the other side around the service panel 124. That is, the first outdoor heat exchanger 210 and the second outdoor heat exchanger 220 are disposed symmetrically around the service panel 124, and as a result, the efficiency of the first outdoor heat exchanger 210 and the second outdoor heat exchanger 220 may be uniformly formed.

The first outdoor heat exchanger 210 and the second outdoor heat exchanger 220 are each formed in a "⊏" shape. The first outdoor heat exchanger 210 and the second outdoor heat exchanger 220 are disposed to face each other, and devices such as the compressor 130, the accumulator 140, the four-way valve 150, the outdoor blowing fan 160 are disposed therebetween.

The first outdoor heat exchanger 210 is bent in a "⊏" shape to cover the front, left, and rear surfaces of the case 120, and the second outdoor heat exchanger 220 is bent in a "⊏" shape to cover the front, right, and rear surfaces of the case 120.

The first outdoor heat exchanger 210 and the second outdoor heat exchanger 220 are disposed to face each other, and both ends thereof are spaced apart from each other. Ends disposed on the front side are disposed widely spaced apart from each other, and the other ends disposed on the rear surface are disposed in close to each other.

The one end 211 and 221 forms a spaced space S for service.

The other ends 212 and 222 are covered by a second bracket 174.

Air sucked into the case 120 through the air panel 122 passes through the first outdoor heat exchanger 210 and the second outdoor heat exchanger 220 in a horizontal direction.

The first outdoor heat exchanger 210 is installed upright in a vertical direction and is coupled and fixed to the base 110 and the case 120. The second outdoor heat exchanger 220 is installed upright in a vertical direction and is coupled and fixed to the base 110 and the case 120.

In particular, a bracket is used to fix the first outdoor heat exchanger 210 and the second outdoor heat exchanger 220 to the case 120.

An upper end of the first outdoor heat exchanger 210 and the second outdoor heat exchanger 220 may be provided with a support frame 230. The support frame 230 is fixed to the first outdoor heat exchanger 210 and the second outdoor heat exchanger 220 and fixes the first outdoor heat exchanger 210 and the second outdoor heat exchanger 220.

The support frame 230 is provided with the outdoor blowing fan 160.

The outdoor blowing fan 160 is discharged to discharge air upward.

The outdoor heat exchanger will be described in more detail with reference to FIGS. 3 to 5.

The outdoor heat exchangers 210 and 220 include a plurality of radiating fins 250 that are disposed side by side, and a tube 260 that is disposed to penetrate through the fins.

The tube 260 penetrates through the radiating fins 250 and conducts heat from the tube 260 to the radiating fins 250. The radiating fins 250 are used to rapidly diffuse the heat of the tube 260.

Since the outdoor heat exchangers 210 and 220 are symmetrical, only the one outdoor heat exchanger will be described.

The outdoor heat exchanger 210 includes a first heat exchange unit 310 disposed thereabove and a second heat exchange unit 320 disposed below the first heat exchange unit 310. The first heat exchange unit 310 and the second heat exchange unit 320 are stacked and operated as one heat exchanger.

That is, the refrigerant may flow through the first heat exchange unit 310 and the second heat exchange unit 320 in order or in reverse order.

The outdoor heat exchanger 210 has a height H longer than a width W. The height (H) of the outdoor heat exchanger 210 is 1 m or more. In the present embodiment, as the outdoor heat exchanger 210, a fin-tube type heat exchanger is used.

The outdoor heat exchanger 210 has a plurality of zones set in a vertical height direction.

A plurality of zones are set in the first heat exchange unit 310 in the height direction, and a plurality of zones are set in the second heat exchange unit 320 in the height direction.

In the present embodiment, a first zone 311 and a second zone 312 are disposed in the first heat exchange unit 310, and a third zone 313 and a fourth zone 314 are disposed in the second heat exchange unit 320.

The first zone 311, the second zone 312, the third zone 313, and the fourth zone 314 are arranged from the top to the bottom. Unlike the present embodiment, the zones may be subdivided into more zones and arranged. Vertical direction heights H1, H2, H3, and H4 of the first zone 311, the second zone 312, the third zone 313, and the fourth zone 314 are the same. A width W of the first zone 311, the second zone 312, the third zone 313, and the fourth zone 314 in a left-right direction is the same.

In the present embodiment, the radiating fin 250 is manufactured so that a flow rate of air passing through the first zone 311, the second zone 312, the third zone 313, and the fourth zone 314 is uniform.

The radiating fin 250 is made of a metal material having high thermal conductivity and has a plate shape. In addition, a louver 350 penetrating in the thickness direction is disposed on the radiating fin 250.

The louver 350 is formed by cutting and then bending a portion of the radiating fin 250. Since the manufacturing method of the louver 350 is a general technique to those skilled in the art, a detailed description thereof will be omitted.

In the present embodiment, the louver 350 is arranged in a V-shape. Unlike the present embodiment, the louver 350 may have various shapes.

The louver 350 occupies a certain portion of the area of the radiating fin 250.

The louver 350 includes a louver fin 352 that is formed by being cut and then bent in the radiating fin 250, and a cut-out area 351 that is formed in the radiating fin and formed at a position where the louver fin is cut.

The louver fin 352 is bent in a direction crossing the direction in which the radiating fin 250 is formed. In the present embodiment, the louver fin 352 may be bent upward or downward with respect to the radiating fin. The louver fin 352 may be disposed to be inclined in a vertical direction.

In the present embodiment, the areas of the louver fins 352 in each zone. Each are formed differently so that the first zone 311, the second zone 312, the third zone 313, and the fourth zone 314 have a uniform air volume.

An area LA1 of the louver fin in the first zone, an area LA2 of the louver fin in the second zone, an area LA3 of the louver fin in the third zone, and an area LA4 of the louver fin in the fourth zone may be formed to be gradually reduced.

The tube 260 disposed in the first outdoor heat exchanger 210 may be disposed to penetrate through each radiating fin of the first zone 311, the second zone 312, the third zone 313, and the fourth zone 314 of the first outdoor heat exchanger 210. The tube of the second outdoor heat exchanger 220 may also be disposed in the same manner.

Since the outdoor blowing fan 160 is disposed above the outdoor heat exchanger 210, 220, as illustrated in FIG. 6, a wind velocity of the first zone 311 disposed above the outdoor heat exchanger 210 is fastest and a wind velocity of the fourth zone 314 disposed at the bottom is slowest.

That is, when the area of the louver fin is the same, the wind velocity at the location closest to the outdoor blowing fan 160 is fastest, and the wind velocity at the farthest location from the outdoor blowing fan 160 is slowest.

An average air volume of the first zone 311 is defined as Q1, an average air volume of the second zone 312 is defined as Q2, an average air volume of the third zone 313 is defined as Q3, and an average air volume of the fourth zone 314 is defined as Q4. In the present embodiment, the air volumes of each zone are uniformly formed (Q1≈Q2≈Q3≈Q4).

The area of the louver fin disposed in the first zone 311 is defined as LA1, the area of the louver fin disposed in the second zone 312 is defined as LA2, the area of the louver fin disposed in the third zone 313 is defined as LA3, and the area of the louver fin disposed in the fourth zone 314 is defined as LA4.

The areas LA1, LA2, LA3, and LA4 of the louver fin may be the total area of a plurality of louvers arranged in each zone, or the area of the louver fin per unit area.

The areas LA1, LA2, LA3, and LA4 of the louver fin are defined as the sum of the areas of the louver fins bent in the radiating fin 250. When the louver 350 is cut and bent, a cut-out area 351 is formed in the radiating fin 250 by the bent louver fin. The area of the louver fin does not mean the cut-out area 351 but means the area of the bent portion that generates resistance to the flowing air. The resistance to air increases as the area of the bent louver fin increases.

Since the louver 350 is formed by cutting and then bending the plurality of louver fins 352, the areas LA1, LA2, LA3, and LA4 of each zone are a value obtained by summing the areas of the louver fins 352. The plurality of radiating fins 250 form a gap 251, and the louver fin 352 is an area protruding toward the gap 251. The louver fin 352 is an area protruding toward the facing radiating fin 250.

The gap 251 is formed between the two radiating fins 250. In the present embodiment, the gap 251 is formed in the horizontal direction. The plurality of gaps 251 are arranged in the vertical direction.

An average wind velocity of the first zone 311 is defined as V1, an average wind velocity of the second zone 312 is defined as V2, an average wind velocity of the third zone 313 is defined as V3, and an average wind velocity of the fourth zone 314 is defined as V4.

When the air volumes of each zone are uniformly formed, the average wind velocities of each zone have the following relationship: V1>V2>V3>V4, When each air volume is uniformly formed, the areas of the louver fins in each zone have the following relationship. LA1>LA2>LA3>LA4 (see FIG. 7).

Referring to FIG. 7, as the number of louver fins increases from the fourth zone toward the first zone, the total area of the louver fins increases. The area of the louver fin increases from the fourth zone toward the first zone. That is, the area of the louver fin formed on the radiating fin 250 increases from the bottom to the top.

Through the areas of each louver fin, the pressure loss of the zone disposed above the outdoor heat exchanger increases, the pressure loss of the zone disposed below the outdoor heat exchanger is reduced, so the air volumes of each zone may be uniformly formed.

In the present embodiment, the pressure loss is controlled through the areas of the louver fins in each zone, but unlike the present embodiment, the pressure loss may be adjusted by adjusting pitches, angles, and the like of the louvers in each zone.

In the present embodiment, the outdoor heat exchanger is divided into four zones from the top to the bottom. However, unlike the present embodiment, when the outdoor heat exchanger is divided into n zones, it is preferable to have the following ratio: V1:V2:V3: •••:Vn=LA1:LA2:LA3: •••:Lan.

Meanwhile, the present embodiment has described the fin-tube type heat exchanger as an example, but the air velocities of each zone and the area ratio of the louver fins may be applied to a radiating fin of a microchannel heat exchanger.

In the present embodiment, the outdoor blowing fan 160 includes a first outdoor blowing fan 161 that is disposed above the first outdoor heat exchanger 210 and a second outdoor blowing fan 162 that is disposed above the second outdoor heat exchanger 220.

When the outdoor blowing fan 160 is operated, the outdoor blowing fan 160 sucks the air inside the first outdoor heat exchanger 210 and the second outdoor heat exchanger 220 and discharges the air upward.

Thus, outdoor air flows from the outside of the first outdoor heat exchanger 210 and the second outdoor heat exchanger 220 toward the inside of the first outdoor heat exchanger 210 and the second outdoor heat exchanger 220. The outdoor air passes through the first outdoor heat exchanger 210 and the second outdoor heat exchanger 220 in the horizontal direction.

Since the area of the louver fin increases from the fourth zone toward the first zone, the air volume passing through the first zone and the air volume passing through the fourth zone may be uniformly formed.

When the air volume of the first zone and the air volume of the fourth zone are uniformly formed, the uniform heat exchange is performed in each zone of the outdoor heat exchanger. When the heat exchange is uniformly performed in each zone of the outdoor heat exchanger, the imbalance of the refrigerant may be minimized, so the efficiency of the refrigerant cycle may be improved.

In the present embodiment, after the outdoor heat exchanger is divided into a plurality of zones in the vertical direction, the area of the louver fin 352 of the radiating fin 250 is implemented differently, but unlike the present embodiment, the area of the louver fin 352 may be differently implemented for each radiating fin 250.

For example, it may be configured to gradually increase the areas of the louver fins formed in each radiating fin upward from the lower side.

As in the present embodiment, when the air volume or the pressure loss above and below the outdoor heat exchanger is uniformly formed through the area of the louver fin, the entire outdoor heat exchanger may be manufactured into one unit.

In the case of the heat exchanger whose vertical direction height H is 1 m or more, two or more heat exchangers may be stacked and manufactured, but in this case, defects due to assembly may occur. In particular, when two or more heat exchangers are stacked and manufactured, the heat exchangers need to be provided with an inlet and an outlet of the refrigerant, respectively, causing a problem in that the refrigerant needs to be uniformly distributed to the stacked heat exchangers.

However, in the case of the structure as in the present embodiment, even if the length in the vertical direction exceeds 1 meter, the heat exchanger can be manufactured as a single fin-tube type heat exchanger, and as a result, defects due to the distribution or assembly of the refrigerant may be excluded.

Although the embodiments of the present disclosure have been described with reference to the accompanying drawings, the present disclosure is not limited to the above embodiments, but may be manufactured in various different forms, and those with ordinary knowledge in the technical field to which the present disclosure belongs will be able to understand that the present disclosure can be implemented in other specific forms without changing the technical idea or essential characteristics of the present disclosure. Therefore, it should be understood that the above-mentioned embodiments are exemplary in all aspects but are not limited thereto.

DESCRIPTION OF REFERENCE NUMERALS

110: base
120: case
130: compressor
160: outdoor blowing fan
210: outdoor heat exchanger
250: radiating fin
260: tube
310: first heat exchange unit
311: first zone
312: second zone
313: third zone
314: fourth zone
320: second heat exchange unit
350: louver
351: cut-out area
352: louver fin

The invention claimed is:

1. An outdoor unit of an air conditioner, comprising: an outdoor heat exchanger that has a height longer than a width; and an outdoor blowing fan that is disposed above the outdoor heat exchanger and blows air upward from below the outdoor heat exchanger, wherein the outdoor heat exchanger includes:

a plurality of radiating fins that contacts air;

a gap that is formed between the respective radiating fins;

a louver fin that is cut in each of the radiating fins and then bent in a direction crossing the radiating fins; and a cut-out area that is formed in the radiating fin and formed at a position where the louver fin is cut, the radiating fins include:

a first zone that is disposed above the outdoor heat exchanger and disposed close to the outdoor blowing fan; and a second zone that is disposed below the first zone, and an area LA1 of the louver fin in the first zone is formed to be larger than an area LA2 of the louver fin in the second zone.

2. The outdoor unit of claim 1, wherein when an average wind velocity of air passing through the first zone is V1, and an average wind velocity passing through the second zone is V2, the average wind velocities of each zone and the areas of the louver fins in each zone satisfy the following ratio: V1:V2=LA1:LA2.

3. The outdoor unit of claim 1, wherein the area of the louver fin is a total area of the louver fins arranged in the corresponding zone.

4. The outdoor unit of claim 1, wherein the area of the louver fin is the area of the louver fin per unit area of the radiating fin arranged in the corresponding zone.

5. The outdoor unit of claim 1, wherein the outdoor heat exchanger further includes a tube through which a refrigerant flows, and the tube is disposed to penetrate through the radiating fins of the first zone and the radiating fins of the second zone.

6. The outdoor unit of claim 5, wherein the radiating fins are arranged in a horizontal direction, and the tube is disposed in a vertical direction.

7. The outdoor unit of claim 6, wherein the louver fin is arranged inclined in the vertical direction.

8. The outdoor unit of claim 1, further comprising:

a base;

a case that is coupled to the base, is disposed above the base, and surrounds an edge of the base; and a compressor that is disposed inside the case, is disposed above the base, and compresses a refrigerant, wherein the outdoor heat exchanger further includes a first outdoor heat exchanger and a second outdoor heat exchanger that are disposed inside the case, are disposed above the base, and exchange heat between a refrigerant and air, and the outdoor blowing fan further includes:

a first outdoor blowing fan that is disposed inside the case, discharges the air inside the case to the outside, and is disposed above the first outdoor heat exchanger; and a second outdoor blowing fan that is disposed inside the case, discharges the air inside the case to the outside, and is disposed above the second outdoor heat exchanger.

9. The outdoor unit of claim 8, wherein the height of the first outdoor heat exchanger and the second outdoor heat exchanger is 1 meter or more.

10. The outdoor unit of claim 8, wherein when viewed in plan view, the first outdoor heat exchanger and the second outdoor heat exchanger have a "⊏" shape disposed to face each other, and one end and the other end of the first outdoor heat exchanger are spaced apart from one end and the other end of the second outdoor heat exchanger.

11. The outdoor unit of claim 10, further comprising:

a second bracket that covers between the spaced other ends of the first outdoor heat exchanger and the second outdoor heat exchanger.

12. An outdoor unit of an air conditioner, comprising: an outdoor heat exchanger that has a height longer than a width; and an outdoor blowing fan that is disposed above the outdoor heat exchanger and blows air upward from below the outdoor heat exchanger, wherein the outdoor heat exchanger includes:

a plurality of radiating fins that are arranged in a vertical direction;

a gap that is formed in a horizontal direction between the respective radiating fins;

a louver fin that is cut in each of the radiating fins and then bent in a direction crossing the radiating fins; and a cut-out area that is formed in the radiating fin and formed at a position where the louver fin is cut, the radiating fins include:

a first zone that is disposed above the outdoor heat exchanger and disposed close to the outdoor blowing fan;

a second zone that is disposed below the first zone;

a third zone that is disposed below the third zone; and a fourth zone that is disposed below the third zone, and an area LA1 of the louver fin in the first zone is formed to be larger than an area LA2 of the louver fin in the second zone, and the LA2 of the louver fin in the second zone is formed to be narrower than the area LA3 of the louver fin in the third zone, and the area LA3 of the louver fin in the third zone is formed to be larger than an area LA4 of the louver fin in the fourth zone.

13. The outdoor unit of claim 12, wherein when an average wind velocity of air passing through the first zone is V1, an average wind velocity passing through the second zone is V2, an average wind velocity of air passing through the third zone is V3, and an average wind velocity passing through the fourth zone is V4, the average wind velocities of each zone and the areas of the louver fins in each zone satisfy the following ratio: V1:V2:V3:V4=LA1:LA2:LA3:LA4.

14. The outdoor unit of claim 12, wherein the area LA1 of the louver fin in the first zone, the area LA2 of the louver fin in the second zone, the area LA3 of the louver fin in the third zone, and the area LA4 of the louver fin in the fourth zone are formed to be gradually reduced.

15. The outdoor unit of claim 12, further comprising:

a base;

a case that is coupled to the base, disposed above the base, and surrounds an edge of the base; and a compressor that is disposed inside the case, located above the base, and compresses a refrigerant, wherein the outdoor heat exchanger further includes a first outdoor heat exchanger and a second outdoor heat exchanger that are disposed inside the case, located above the base, and exchange heat between a refrigerant and air, and the outdoor blowing fan further includes:

a first outdoor blowing fan that is disposed inside the case, discharges the air inside the case to the outside, and is disposed above the first outdoor heat exchanger; and a second outdoor blowing fan that is disposed inside the case, discharges the air inside the case to the outside, and is disposed above the second outdoor heat exchanger.

* * * * *